US009945219B2

(12) United States Patent
Stehle et al.

(10) Patent No.: US 9,945,219 B2
(45) Date of Patent: Apr. 17, 2018

(54) PROCESS FOR PRODUCING MINERAL OIL FROM UNDERGROUND MINERAL OIL DEPOSITS

(75) Inventors: Vladimir Stehle, Kassel (DE); Konrad Siemer, Kassel (DE); Liubov Altunina, Tomsk (RU); Vladimir A. Kuvshinov, Tomsk (RU); Ivan Kuvshinov, Tomsk (RU)

(73) Assignee: WINTERSHALL HOLDING GMBH, Tomsk (RU)

( * ) Notice: Subject to any disclaimer, the term of this patent is extended or adjusted under 35 U.S.C. 154(b) by 828 days.

(21) Appl. No.: 13/251,568

(22) Filed: Oct. 3, 2011

(65) Prior Publication Data

US 2012/0080187 A1 Apr. 5, 2012

Related U.S. Application Data

(60) Provisional application No. 61/389,313, filed on Oct. 4, 2010.

(51) Int. Cl.
*E21B 43/24* (2006.01)
*E21B 43/26* (2006.01)
*E21B 43/20* (2006.01)

(52) U.S. Cl.
CPC ..... *E21B 43/261* (2013.01); *E21B 43/20* (2013.01)

(58) Field of Classification Search
CPC .... E21B 33/138; E21B 36/006; C09K 8/5045
USPC ..... 166/293, 400
See application file for complete search history.

(56) References Cited

U.S. PATENT DOCUMENTS 3,530,937 A * 9/1970 Bernard ..... 166/270
3,601,195 A * 8/1971 Hearn ..... 166/288
3,785,437 A * 1/1974 Clampitt ..... C09K 8/42 166/281
3,815,681 A * 6/1974 Richardson ..... 166/281
(Continued)

FOREIGN PATENT DOCUMENTS

RU 2 338 768 C1 11/2008
RU 2 339 803 C2 11/2008
(Continued)

OTHER PUBLICATIONS

L. K. Altunina and V. A. Kuvshinov in Oil & Gas Science and Technology—Rev. IFP, vol. 63 (2008) (1), pp. 37 to 48, Figure 2, p. 39.

(Continued)

*Primary Examiner* — William D Hutton, Jr.
*Assistant Examiner* — Avi T Skaist
(74) *Attorney, Agent, or Firm* — Drinker Biddle & Reath LLP

(57) ABSTRACT

A process for producing mineral oil from mineral oil deposits, in which the mineral oil yield is increased by blocking highly permeable regions of the mineral oil formation by separate injection of at least one acidic formulation which comprises water-soluble Al(III) salts, and one urea- or urea derivative-comprising formulation into the deposit, said formulations not mixing with one another until within the deposit, and the mixture forming highly viscous gels under the influence of the deposit temperature. The process can be used especially in the final stage of deposit development, when watering out in production increases, and particularly after the steam flooding of the deposits.

20 Claims, 5 Drawing Sheets

(56) References Cited

U.S. PATENT DOCUMENTS

| | | | | |
|---|---|---|---|---|
| 4,004,639 | A * | 1/1977 | Sandiford | 166/292 |
| 4,141,416 | A | 2/1979 | Holm | |
| 5,156,214 | A * | 10/1992 | Hoskin et al. | 166/270 |
| 5,215,147 | A * | 6/1993 | Grego | C09K 8/5086 166/270 |
| 6,401,819 | B1 * | 6/2002 | Harris et al. | 166/300 |
| 7,273,101 | B2 | 9/2007 | Davies et al. | |
| 2006/0151171 | A1 * | 7/2006 | Davies et al. | 166/294 |
| 2008/0035344 | A1 * | 2/2008 | Odeh et al. | 166/295 |
| 2011/0088899 | A1 | 4/2011 | Stehle et al. | |

FOREIGN PATENT DOCUMENTS

| | | |
|---|---|---|
| RU | 2 361 074 C2 | 7/2009 |
| SU | 1 654 554 A1 | 6/1991 |

OTHER PUBLICATIONS

Borling et al. "Pushing Out the Oil with Conformance Control" in Oilfield Review (1994), pp. 44 ff.

* cited by examiner

PROCESS FOR PRODUCING MINERAL OIL FROM UNDERGROUND MINERAL OIL DEPOSITS

CROSS-REFERENCE TO RELATED APPLICATION

This application claims the benefit of U.S. Provisional Application Ser. No. 61/389,313 filed Oct. 4, 2010, the entire contents of which are incorporated herein by reference in its entirety.

FIELD OF THE INVENTION

The present invention relates to a process for producing mineral oil from mineral oil deposits, in which the mineral oil yield is increased by blocking highly permeable regions of the mineral oil formation by separate injection of at least two different formulations into the deposit, said formulations not mixing with one another until within the deposit, and the mixture forming highly viscous gels under the influence of the deposit temperature. The process can be used especially in the final stage of deposit development, when watering out in production increases, and particularly after the steam flooding of the deposits.

Background

In natural mineral oil deposits, mineral oil occurs in cavities of porous reservoir rocks which are closed off from the surface of the earth by impervious covering layers. In addition to mineral oil, including proportions of natural gas, a deposit further comprises water with a higher or lower salt content. The cavities may be very fine cavities, capillaries, pores or the like, for example those having a diameter of only approx. 1 μm; the formation may additionally also have regions with pores of greater diameter and/or natural fractures.

After the borehole has been sunk into the oil-bearing strata, the oil at first flows to the production boreholes owing to the natural deposit pressure, and erupts from the surface of the earth. This phase of mineral oil production is referred to by the person skilled in the art as primary production. In the case of poor deposit conditions, for example a high oil viscosity, rapidly declining deposit pressure or high flow resistances in the oil-bearing strata, eruptive production rapidly ceases. With primary production, it is possible on average to extract only 2 to 10% of the oil originally present in the deposit. In the case of higher-viscosity oils, eruptive production is generally completely impossible.

In order to enhance the yield, what are known as secondary production processes are therefore used.

The most commonly used process in secondary mineral oil production is water flooding. This involves injecting water through the injection boreholes into the oil-bearing strata. This artificially increases the deposit pressure and forces the oil out of the injection boreholes to the production boreholes. By water flooding, it is possible to substantially increase the yield level under particular conditions.

In the ideal case of water flooding, a water front proceeding from the injection borehole should force the oil homogeneously over the entire mineral oil formation to the production borehole. In practice, a mineral oil formation, however, has regions with different levels of flow resistance. In addition to oil-saturated reservoir rocks which have fine porosity and a high flow resistance for water, there also exist regions with low flow resistance for water, for example natural or synthetic fractures or very permeable regions in the reservoir rock. Such permeable regions may also be regions from which oil has already been recovered. In the course of water flooding, the flooding water injected naturally flows principally through flow paths with low flow resistance from the injection borehole to the production borehole. The consequences of this are that the oil-saturated deposit regions with fine porosity and high flow resistance are not flooded, and that increasingly more water and less mineral oil is produced via the production borehole. In this context, the person skilled in the art refers to "watering out of production". The effects mentioned are particularly marked in the case of heavy or viscous mineral oils. The higher the mineral oil viscosity, the more probable is rapid watering out of production.

For production of mineral oil from deposits with high mineral oil viscosity, the mineral oil can also be heated by injecting steam into the deposit, thus reducing the oil viscosity. As in the case of water flooding, however, steam and steam condensate can also strike undesirably rapidly through highly permeable zones from the injection boreholes to the production boreholes, thus reducing the efficiency of the tertiary production.

The prior art discloses measures for closing such highly permeable zones between injection boreholes and production boreholes by means of suitable measures. As a result of these, highly permeable zones with low flow resistance are blocked and the flood water or the flood steam flows again through the oil-saturated, low-permeability strata. Such measures are also known as "conformance control". An overview of measures for conformance control is given by Borling et al. "Pushing out the oil with Conformance Control" in Oilfield Review (1994), pages 44 ff.

For conformance control, it is possible to use comparatively low-viscosity formulations of particular chemical substances which can be injected easily into the formation, and the viscosity of which rises significantly only after injection into the formation under the conditions which exist in the formation. To enhance the viscosity, such formulations comprise suitable inorganic, organic or polymeric components. The rise in viscosity of the injected formulation can firstly occur with a simple time delay. However, there are also known formulations in which the rise in viscosity is triggered essentially by the temperature rise when the injected formulation is gradually heated to the deposit temperature in the deposit. Formulations whose viscosity rises only under formation conditions are known, for example, as "thermogels" or "delayed gelling systems".

SU 1 654 554 A1 discloses a process for extracting oil using mixtures of aluminum chloride or aluminum nitrate, urea and water, which are injected into the mineral oil formation. At the elevated temperatures in the formation, the urea is hydrolyzed to carbon dioxide and ammonia. The release of the ammonia base significantly increases the pH of the water, and results in precipitation of a highly viscous gel of aluminum hydroxide, which blocks the highly permeable zones.

US 2008/0035344 A1 discloses a mixture for blocking underground formations with delayed gelation, which comprises at least one acid-soluble crosslinkable polymer, for example partly hydrolyzed polyacrylamide, a partly neutralized aluminum salt, for example an aluminum hydroxide chloride, and an activator which can release bases under formation conditions, for example urea, substituted ureas or hexamethylenetetramine. The mixture can preferably be injected at a temperature of 0 to 40° C., and gelates at temperatures above 50° C., according to the use conditions, within 2 h to 10 days.

RU 2 339 803 C2 discloses a process for blocking such highly permeable zones, in which the volume of the highly permeable zones to be blocked is first of all determined. Subsequently, in a first process step, an aqueous formulation composed of carboxymethylcellulose and chromium acetate as a crosslinker is injected at 15% by volume, based on the total volume of the zone in the mineral oil formation to be blocked. In a second step, an aqueous formulation of polyacrylamide and a crosslinker is injected.

RU 2 361 074 discloses a process for blocking highly permeable zones, in which portions of formulations based on urea and aluminum salts are injected into a deposit with high deposit temperature.

L. K. Altunina and V. A. Kuvshinov in Oil & Gas Science and Technology—Rev. IFP, Vol. 63 (2008) (1), pages 37 to 48 describe different thermogels and the use thereof for oil production, including thermogels based on urea and aluminum salts, and thermogels based on cellulose ethers.

U.S. Pat. No. 4,141,416 discloses a process for tertiary mineral oil production, in which an aqueous alkaline silicate solution is injected into a mineral oil formation to lower the water-oil interfacial tension, thus reducing the oil-water interfacial tension. In one variant, it is possible simultaneously to close permeable regions of the mineral oil formation, by injecting additional components in a second step, for example acids which can form precipitates with the alkaline silicate solution.

RU 2 338 768 C1 discloses a process for blocking permeable zones in oil deposits, in which a solution comprising sodium phosphate, sodium oxalate, sodium carbonate and a mixture of carboxymethylcellulose and xanthan, and also a second solution comprising calcium chloride, copper chloride and aluminum chloride, are each injected separately into the mineral oil formation, and the two formulations do not mix until underground. In order to prevent premature mixing, it is possible to inject a portion of water into the mineral oil formation between the two formulations. After mixing, the formulations form precipitates of sparingly soluble hydroxides and sparingly soluble calcium salts. The specification does not disclose any combination of the process with steam flooding. Nor does it disclose precipitation as a function of temperature.

Instead, the precipitates are formed without a delay when the two solutions are mixed. In this way it is difficult to block those areas of the formation that are at a greater distance from the injector.

Conformance control in connection with steam flooding, however, presents a series of particular difficulties. Steam used for steam flooding typically has a temperature of more than 300° C. Accordingly, the mineral oil formation may heat up to more than 300° C. at the site of the injection borehole. Although the temperature decreases with increasing distance from the injection borehole, long-lasting, permanent steam flooding frequently causes the temperature to decline back to the natural deposit temperature only several hundred meters away from the steam injection, and even the very hot zone around the injection borehole may have a considerable extent. After prolonged steam flooding, a hot zone of 250° C. to 300° C. may form in a radius of several meters around the injection borehole. This zone may have a radius of up to 40 meters when the deposit has a relatively homogeneous permeability. In the case of a deposit which has highly permeable channels, and the steam accordingly flows predominantly through the highly permeable channels, the hot zone may also extend over even greater distances.

On the one hand, many formulations of the prior art, especially those based on organic materials, are no longer sufficiently stable at the temperatures which may prevail after steam flooding in a mineral oil formation.

The gel-forming formulations identified above, comprising aluminum salts and urea, have a very good temperature stability, and thus in principle are also suitable for formations after steam flooding. With such formulations, however, the problem arises that the time until the abovementioned gel-forming formulations actually form gels depends not only on the composition and the concentration of the components but of course on the temperature, and the higher the temperature, the more rapidly gel is formed. While gel formation at temperatures of 50 to 120° C. can take hours, days or even weeks, gel is of course formed more rapidly at higher temperatures: L. K. Altunina and V. A. Kuvshinov present, in Oil & Gas Science and Technology—Rev. IFP, Vol. 63 (2008) (1), pages 37 to 48, FIG. 2, page 39, measurements for a gel-forming formulation in the form of aluminum salts and urea. At 150° C. gel formation sets in after 40 min, at 200° C. after 20 min, and at 250° C. after 10 min. When such formulations are injected into a hot injection borehole or a hot formation, there is the risk that gel formation will set in already in the immediate zone around the injection borehole, since the flow rate of the formulation in the mineral oil formation is usually so low that it is heated up very rapidly after the injection.

Thus, the injected formulations completely fail to reach the highly permeable zones that they are actually supposed to block, and viscous gels are instead formed at the injection borehole or in the zone close to the borehole. The gels can hinder the further pumping of the gel-forming formulation, and subsequent water or steam flooding can of course also be prevented.

The problems can be partly solved by allowing the steam injected to cool a little after the injection of steam, or additionally injecting water for cooling, but such a procedure takes time and does not guarantee flawless pumping of the gel-forming formulations into the deposit.

BRIEF SUMMARY

It was therefore an object of the invention to provide a process for producing mineral oil from mineral oil formations with very hot zones, in which the watering out of production is reduced and the oil recovery rises, and which can also be executed directly after steam flooding of the mineral oil formation.

Accordingly, a process has been found for producing mineral oil from underground mineral oil deposits into which at least one injection borehole and at least one production borehole have been sunk, said process comprising at least the following process steps:

(1) injection of steam into at least one injection borehole and withdrawal of mineral oil through at least one production borehole, the temperature at the injection borehole after process step (1) being 90° C. to 320° C., and (2) blocking of highly permeable zones in the mineral oil deposit in the region between the at least one injection borehole and the at least one production borehole by injecting aqueous formulations through at least injection borehole, said formulations comprising water and chemical components which, after injection into the deposit, can form gels under the influence of the deposit temperature, (3) continuing of the production of mineral oil through at least one production borehole, and which comprises performing process step (2) by injecting at least an acidic formulation F1 which comprises at least water and a water-soluble aluminum(III) salt and/or a partially hydrolyzed aluminum(III) salt, and a formulation F2 which comprises at least water and at least one water-soluble activator which causes an increase in the pH when heated to a temperature of >50° C., the activator being a compound selected from the group of urea and substituted water-soluble ureas, each separately into the deposit, the formulations mixing with one another in the formation after injection, and forming viscous gels after heating under the influence of the deposit.

In a preferred embodiment, three portions of the formulation are injected in succession, to be precise, in the sequence F1-F2-F1 or F2-F1-F2.

The process according to the invention has the advantage that it is also possible to selectively block highly permeable zones in deposits with high temperature by means of suitable gels. The process enables direct performance of the profile modification in the hot carrier directly after the steam flooding. The distance between the borehole and the gel bank is thus controllable. This achieves efficient blocking of highly permeable zones, reduces watering out of production and increases oil recovery.

DETAILED DESCRIPTION OF THE PREFERRED EMBODIMENTS

Figure 1:
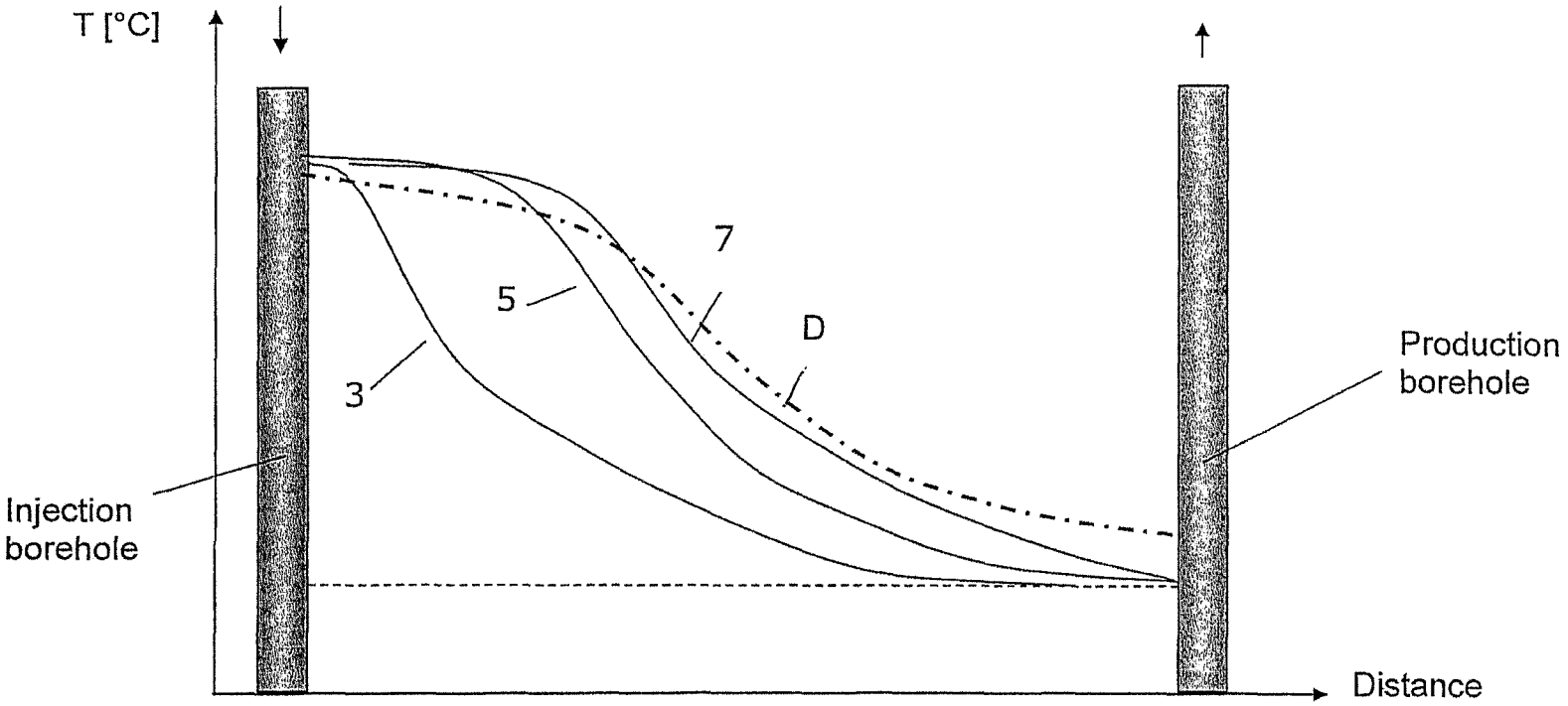
FIG. 1 Schematic diagram of the temperature profile in an oil deposit after prolonged steam flooding FIG. 2 Diagram of the pressure profile of a core flooding test using formulations F1 and F2

With regard to the invention, the following specific details are given:

The process according to the invention for production of mineral oil is a process for secondary or tertiary mineral oil production, i.e. it is employed after primary mineral oil production has stopped owing to the autogenous pressure of the deposit, and the pressure in the deposit has to be maintained by injecting water and/or steam.

Deposits

The deposits may be deposits for all kinds of oil, for example those for light or heavy oil. In one embodiment of the invention, the deposits are heavy oil deposits, i.e. deposits which comprise mineral oil with an API gravity of less than 22.3° API.

To perform the process, at least one production borehole and at least one injection borehole are sunk into the mineral oil deposit. In general, one deposit is provided with several injection boreholes and with several production boreholes.

The initial deposit temperature—i.e. the temperature before employment of the process according to the invention—is typically in the range from 25° C. to 150° C., preferably 30° C. to 140° C., more preferably 35° C. to 130° C., even more preferably 40° C. to 120° C., and, for example, 50 to 110° C. The deposit temperature changes as a result of employment of the process according to the invention, at least in the region between the injection boreholes and the production boreholes.

Process

According to the invention, the process comprises at least three process steps (1), (2) and (3), which are performed in this sequence, but not necessarily in immediate succession. The process may of course comprise further process steps, which can be performed before, during or after steps (1), (2) and (3).

Process step (1)

In a first process step, (1), steam is injected into the at least one injection borehole and mineral oil is withdrawn through at least one production borehole. The term "mineral oil" in this context of course does not mean single-phase oil, and what is meant is instead the customary emulsions which comprise oil and formation water and are produced from mineral oil deposits. The steam injected generally has a temperature of up to 320° C., especially 250° C. to 320° C. and preferably 280° C. to 320° C.

As a result of the injection of steam, there forms, in the region between the injection borehole and the production borehole, a zone in which oil is displaced by steam or water (formation water or water formed by condensation of steam).

As a result of the injection of steam, the temperature at the injection borehole increases, and at the end of process step (1) is 90° C. to 320° C. In particular, the temperature at the injection borehole(s) after process step (1) is 120° C. to 320° C., preferably 150° C. to 300° C., more preferably 180° C. to 300° C. and, for example, 250 to 300° C.

As a result of the injection, there also forms a hot zone around the injection borehole. The hot zone may have a radius of approx. 5 m up to approx. 50 m around the injection borehole, depending on the flood time, flood volume and temperature of the steam. When a plurality of injection boreholes are present and steam is injected through each of the injection boreholes, such a hot zone forms around each of the injection boreholes.

As a result of the flow of steam or condensed water or heated formation water from the injection boreholes in the direction of the production boreholes, the entire region between the at least one injection borehole and the at least one production borehole can heat up to temperatures above the natural deposit temperature, the heating of course decreasing with increasing distance from the injection borehole(s).

These facts are shown schematically and illustratively in FIG. 1. FIG. 1 shows a schematic of a section of a mineral oil deposit which has a steam injector and a production borehole present at a certain distance therefrom. The original deposit temperature is $T_0$. As a result of injection of hot steam, the deposit temperature increases to an ever greater degree with time proceeding from the injection borehole. FIG. 1 shows the temperature profiles after 3, 5 and 7 years of steam injection, and at the breakthrough of the steam (curve D) from the injection borehole to the production borehole.

The upper temperature limit in the hot zone corresponds to the upper temperature limit at the injection borehole. However, according to the duration of the steam injection, it may be lower with increasing distance from the injection borehole.

Process step (2)

Process step (2) may be employed as soon as production is subject to excessive watering out, or a steam breakthrough is registered. In the event of a steam breakthrough, steam flows through highly permeable zones from the injection borehole to the production borehole. However, highly permeable zones need not necessarily be generated by the steam flooding, but may also be present naturally in a formation. In addition, it is possible that permeable zones have already been created in a process step preceding the process according to the invention.

To prepare for process step (2), it is advantageous to measure the temperature in the region of the injection borehole and to determine the temperature field of the deposit in the region affected by the flooding. Methods for determining the temperature field of a mineral oil deposit are known in principle to those skilled in the art. The temperature distribution is generally undertaken from temperature measurements at particular sites in the formation, in combination with simulation calculations, which take account of factors including amounts of heat introduced into the formation and the amounts of heat removed from the formation. Alternatively, any of the regions can also be characterized by the average temperature thereof. It will be clear to the person skilled in the art that the outlined analysis of the temperature field constitutes merely an approximation of the actual conditions in the formation.

Process step (2) can be performed immediately after process step (1).

Before the execution of process step (2), it is, however, optionally possible to lower the temperature in the region of the injection borehole in order to facilitate the trouble-free performance of process step (2). This can be accomplished by simply waiting. In a further embodiment of the invention, cold water can optionally be injected into the injection borehole, thus reducing the temperature in the region of the injection borehole and in the zone close to the borehole.

In the course of process step (2), highly permeable zones in the mineral oil deposit in the region between the injection boreholes and the production boreholes are blocked by injection of aqueous formulations through the at least one injection borehole.

According to the invention, for this purpose, at least two different aqueous formulations F1 and F2 are used. The formulation F1 comprises at least water and one or more water-soluble aluminum(III) salt and/or a partially hydrolyzed aluminum(III) salt, and formulation F2, which is different therefrom, comprises at least water and one or more water-soluble activators which cause an increase in the pH when heated to a temperature of >50° C. The increase in the pH gives rise to aluminum compounds which are poorly soluble.

To execute the process, the at least two formulations F1 and F2 are each injected separately through one or more injection boreholes into the deposit. These are the same injection boreholes which have been used in process step (1) for injection of steam.

The injection is undertaken in such a way that the two formulations mix in the formation after injection.

Formulations F1 and F2

According to the invention, the compositions of formulations F1 and F2, with regard to the chemical components thereof, are such that, after mixing underground, they form viscous gels under the influence of the deposit after heating to a minimum temperature T>50° C., while the separate, unmixed formulations F1 and F2 cannot form gels even under the influence of the deposit temperature. The viscous gels formed block cavities in the mineral oil formation, thus blocking flow paths for water and/or steam.

In accordance with the invention, formulation F1 is an acidic aqueous formulation which comprises at least water and a water-soluble aluminum (III) salt and/or a partially hydrolyzed aluminum(III) salt, and formulation F2 is an aqueous formulation which comprises at least water and a water-soluble activator which causes an increase in the pH when heated to a temperature of >50° C.

In addition to water, the formulations may optionally comprise further, water-miscible organic solvents. Examples of such solvents comprise alcohols. In general, the formulations (F), however, should comprise at least 80% by weight of water, based on the sum of all solvents in the formulation, preferably at least 90% by weight and more preferably at least 95% by weight. Most preferably, only water should be present.

The water-soluble aluminum(III) salts may be, for example, aluminum chloride, aluminum bromide, aluminum nitrate, aluminum sulfate, aluminum acetate or aluminum acetylacetonate.

These aluminum compounds may also be already partly hydrolyzed aluminum(III) salts, for example aluminum hydroxychloride. It will be appreciated that it is also possible to use mixtures of two or more different aluminum compounds. The pH of formulation F1 is ≤5, preferably ≤4.5 and more preferably ≤4. These aluminum compounds are preferably aluminum(III) chloride and/or aluminum(III) nitrate. When reacted with bases, aluminum(III) salts which are dissolved in water form poorly soluble water-containing gels.

The water-soluble activators in formulation F2 release bases when heated to a temperature of >50° C. in an aqueous medium, and thus ensure an increase in the pH of the solution. The water-soluble activators used may, for example, be urea and substituted water-soluble ureas such as N,N'-alkylureas, especially N-methylurea, N,N'-dimethylurea or N,N'-dimethylolurea. Urea and the stated urea derivatives are hydrolyzed in an aqueous medium to ammonia or amines and $CO_2$. The rate of hydrolysis is, of course, dependent on the temperature, and increases as the temperature increases. It will be appreciated that it is also possible to use mixtures of two or more different activators. For execution of the present invention, preference is given to urea. It will be appreciated that in addition to the stated activators, the formulations may comprise still more water-soluble activators.

Formulations F1 and F2 may additionally comprise further components which can accelerate or slow gel formation. Examples comprise further salts or naphthenic acids. In addition, formulations F1 and F2 may also comprise thickening additives, for example thickening polymers.

After mixing formulations F1 and F2 and heating to temperatures of >50° C., the increase in the pH forms high-viscosity, water-insoluble gels which comprise metal ions, hydroxide ions and possibly further components. In the case of use of aluminum compounds, an aluminum hydroxide or aluminum oxide hydrate gel may form, which may of course comprise further components, for example the anions of the aluminum salt used.

In the preferred variant, it has been found to be useful, in formulation F1, to use the aluminum(III) salts or the partially hydrolyzed aluminum(III) salts, in an amount of 3 to 30% by weight, preferably 5 to 25% by weight, based on the sum of all components of the formulation, this figure being based on anhydrous metal compounds.

It has likewise been found to be useful, in formulation F2, to use the water-soluble activator(s) in an amount of 3 to 60% by weight, preferably 10 to 45% by weight, based on the sum of all components.

The concentration of the activator should therefore be such that a sufficient amount of base can form to lower the pH to such an extent that a gel can indeed precipitate out. In the case of aluminum(III) salts, the amount of the activator should at least be such that 3 mol of base are released per mole of Al(III). In the case of partially hydrolyzed Al(III) salts, it can be less satisfactory depending on the degree of hydrolysis.

The concentration of the components can in principle also be used to determine the time until gel formation after mixing, although it should be considered that the mixing of formulations F1 and F2 in the formation need not be complete, and that a certain degree of uncertainty accordingly remains in the adjustment of gel formation times. The higher the concentration of the activator, the greater the rate of gel formation—at a given concentration of the metal compound. This connection can be utilized by the person skilled in the art in order to prolong or to shorten the gel formation time in a controlled manner.

In table 1 below, the time until gel formation of a gel-forming formulation is compiled by way of example for different temperatures, the formulation having been obtained by mixing two formulations F1 and F2. F1 comprises 16% by weight of $AlCl_3$ (calculated as anhydrous aluminum chloride) and 84% by weight of water, and F2 comprises 50% by weight of urea and 50% by weight of water. The mixture accordingly comprises 8% by weight of $AlCl_3$, 25% by weight of urea and 67% by weight of water.

TABLE 1

Time until gel formation at different temperatures

| | Temperature [° C.] | | | | |
|---|---|---|---|---|---|
| | 100 | 90 | 80 | 70 | 60 |
| Gel formation time [days] | ¼ | 1 | 3 | 6 | 30 |

Table 2 below shows the time until gel formation for different mixtures of $AlCl_3$ (calculated as anhydrous product), urea and water at 100° C. or 100° C. It is seen that the time until formation of the gel becomes ever longer with decreasing amount of the urea activator.

TABLE 2

Time until gel formation ("—" no measurement).

| F1 $AlCl_3$ | F2 urea | Concentration of the mixture [% by wt.] | | $AlCl_3$/urea weight | Time until gel formation [h] | |
|---|---|---|---|---|---|---|
| [% by wt.] | [% by wt.] | $AlCl_3$ | Urea | ratio | 100° C. | 110° C. |
| 8 | 32 | 4 | 16 | 1:4 | 4.0 | — |
| 8 | 24 | 4 | 12 | 1:3 | 4.3 | — |
| 8 | 16 | 4 | 8 | 1:2 | 7.3 | — |
| 8 | 8 | 4 | 4 | 1:1 | 19.0 | — |
| 16 | 60 | 8 | 30 | 1:3.75 | 5.3 | 2 |
| 4 | 15 | 2 | 7.5 | 1:3.75 | — | 8 |
| 16 | 48 | 8 | 24 | 1:3 | 5.5 | — |
| 16 | 32 | 8 | 16 | 1:2 | 8.3 | — |
| 16 | 16 | 8 | 8 | 1:1 | 18.0 | — |
| 16 | 12 | 8 | 6 | 1:0.75 | 23.0 | — |

% by wt. relates to the sum of all components of the aqueous formulations F1 and F2 or mixture thereof.

The stated gels based on aluminum salts and urea can be used even at relatively high temperatures. L. K. Altunina and V. A. Kuvshinov in Oil & Gas Science and Technology—Rev. IFP, Vol. 63 (2008) (1), pages 37 to 48, present, in FIG. 2 on page 39, measurement values for a gel-forming formulation in the form of aluminum salts and urea at relatively high temperatures. Gelling starts after 40 minutes at 150° C., after 20 minutes at 200° C., and after 10 minutes at 250° C.

U.S. Pat. No. 7,273,101 B2 discloses the use of mixtures comprising partially hydrolyzed aluminum chloride, for example $Al_2(OH)_2Cl*2.5\ H_2O$, and urea and/or urea derivatives such as dimethyl urea, for example, for forming gels. The mixtures may further comprise inorganic particles, more particularly finely divided $SiO_2$, or $SiO_2$ coated with aluminum compounds. The specification observes that the time to gelling in the temperature range from 45 to 140° C. can be set at 12 to 96 hours.

The formulations described, based on aluminum salts and activators, have the advantage that inorganic gels are formed. The gels are stable up to temperatures of 300° C. and are therefore very particularly suitable for deposits with very high temperatures, such as the present hot deposits after steam flooding. In addition, the inorganic gels, if required, can also be removed again very easily from the formation, by injecting an acid into the formation and dissolving the gels.

Performance of Process Step (2)

According to the invention, the at least two formulations F1 and F2 are each injected separately into the deposit through one or more injection boreholes, and the formulations do not mix until underground. The injection of formulations F1 and F2 is generally followed by flooding with further water.

In this case, the formulations should mix with one another around the injection borehole only after passing through the first hot zone, in order that they actually reach the highly permeable zones in the mineral oil formation and do not form gels too early.

In order to achieve this, it is advisable to reduce the skin factor of the borehole by known technical measures, and to perform the pumping of the formulations F1 and F2 with maximum injection rates and with maximum pressure. This results in the formulations passing rapidly through the hottest zone as soon as they have gone around the injection borchole.

Advantageously, it is also possible, as already described above, to cool the formation a little in the zone close to the borehole before injection of formulations F1 and F2, for example by water flooding. It is also advisable to use, as mixing water for formulations F1 and F2 and for optional water flooding, water with a low temperature, especially water with a temperature of less than 20° C. The injected formulations F1 and F2, respectively, ought to have a pre-injection temperature—that is a temperature prior to entry into the borehole—of less than 40° C., preferably less than 20° C., more preferably less than 10° C., and with particular preference a temperature of not more than 5° C. above the freezing point of the solution.

In a further embodiment, a portion of water is injected between an injection of formulations F1 and F2 or F2 and F1. The volume of water injected here should be not greater than, preferably smaller than, the volume of the subsequently injected portion of F1 or F2. The volume of such a portion of water may especially be 40% to 100% of the subsequently injected portion, preferably 40 to 80% and more preferably 40 to 60%.

In a further preferred embodiment, a formulation F2 is injected first, especially a formulation comprising the water-soluble activator, especially a urea-comprising formulation, and then at least one formulation F1. At the start of the hydrolysis from urea to $C0_2$ and $NH_3$, gas bubbles are formed which increase the viscosity of the formulation. This aids the mixing with the following formulation F1.

In this embodiment, formulation F2 may comprise a viscosity-increasing additive, for example a water-soluble thickening polymer, specifically in such an amount that the viscosity of formulation F2 under deposit conditions is somewhat greater than that of formulation F1 injected thereafter. Examples of such polymers comprise polyacrylamide, microgels based on polyacrylamide or biopolymers. By virtue of the slightly higher viscosity, the flow rate of the first injected portion of formulation F2 in the formation is somewhat lower than that of the subsequently injected formulation F1. Formulation F1 can accordingly penetrate particularly well into the flowing front of formulation F2 and mix therewith. In general, the viscosity of the injected formulation F2 should not be more than 30% higher, for example 10% to 30% higher, than the viscosity of the formulation F1 injected beforehand.

In order to achieve extremely good blocking of high-permeability zones in mineral oil formations, the formulations F1 and F2 in the formation must be mixed as completely as possible. Complete mixing, however, may be hindered by gel formation itself, particularly at relatively high temperatures, if gel formation is already rapid.

Figure 3:
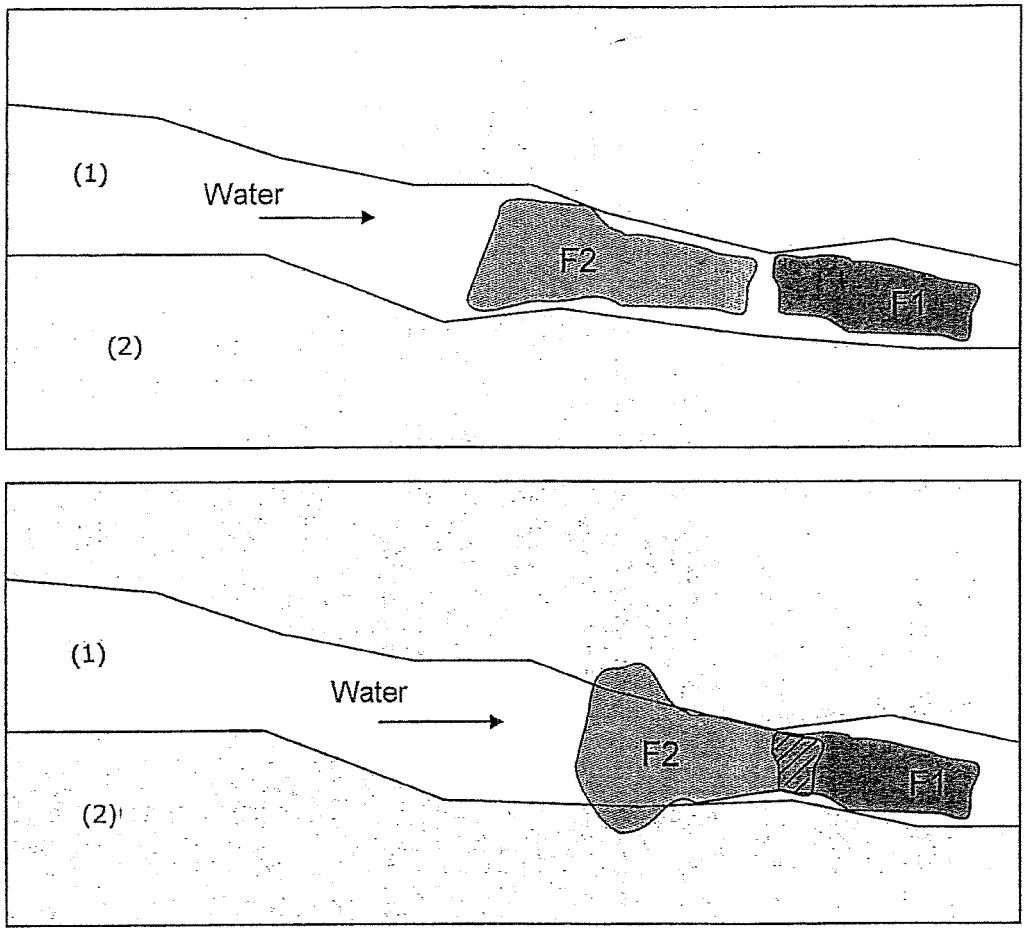
FIG. 3 Schematic diagram of the mixing of two formulations F1 and F2.

This is shown by way of example in FIG. 3. FIG. 3 (top) shows a formulation F1 and a subsequently injected formulation F2, which flow through a high-permeability region (1) of the formation. The high-permeability region is surrounded by a low-permeability region (2), drawn in gray. When the formulation F2 has reached the formulation F1, a gel begins to form at the interface (FIG. 3, bottom). This gel plug at least hinders the further mixing of the formulations F1 and F2. A substantial part of the initially injected formulation spreads further, unused, in the formation.

In a further preferred embodiment of the invention, therefore, 3 portions are injected, namely either a portion of formulation F2, a portion of formulation F1, and a further portion of formulation F2, or a portion of formulation F1, a portion of formulation F2, and a further portion of formulation F1.

Figure 4:
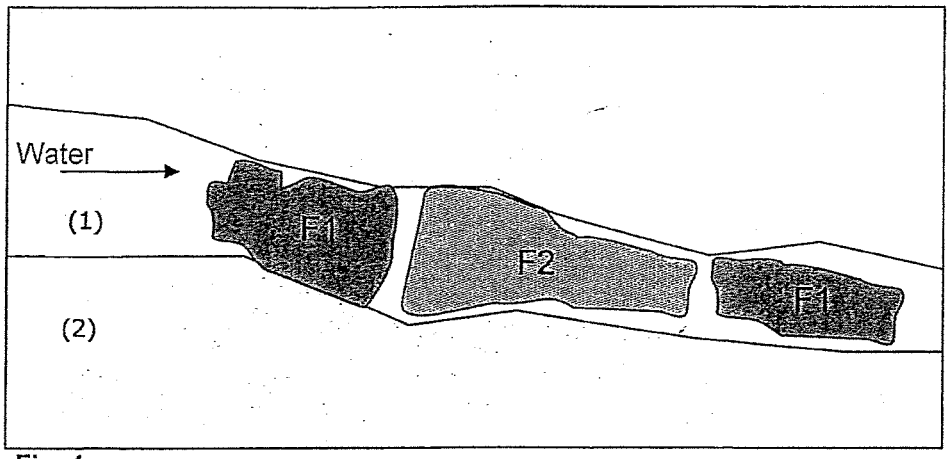
FIG. 4 to FIG. 7 Schematic diagram of the mixing of three portions F1, F2 and F1 injected in succession.
Figure 5:
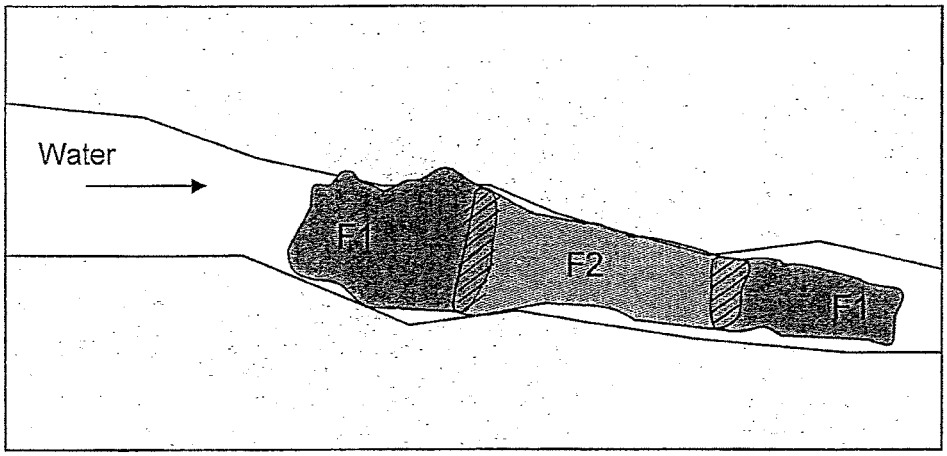
Figure 6:
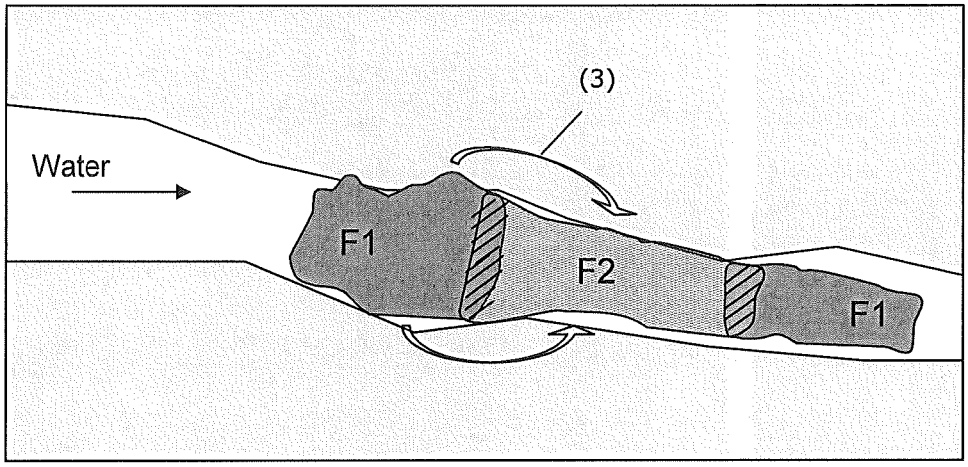
Figure 7:
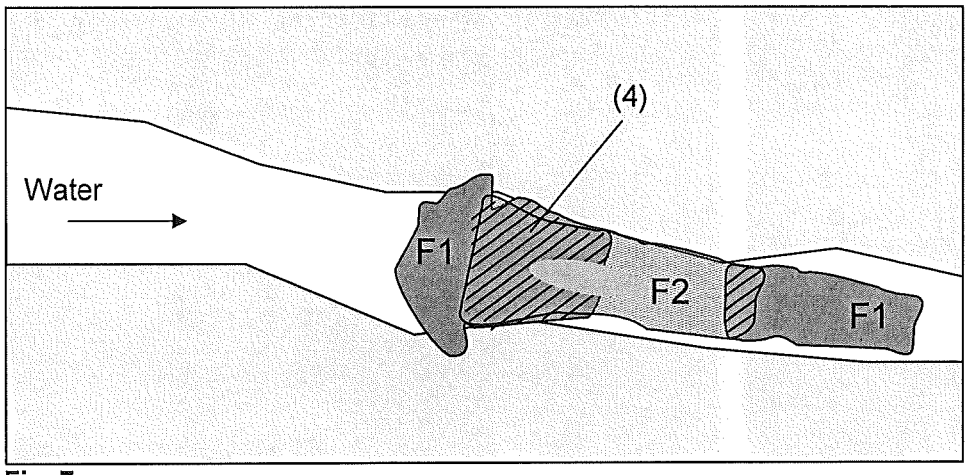

This embodiment and its advantages are shown by way of example in FIGS. 4, 5, 6 and 7. FIG. 4 shows three successively injected portions of F1, F2 and F1. When the formulations begin to mix, gel plugs begin to form at both interfaces between F1 and F2 (FIG. 5). Formulation F2 is enclosed between two gel plugs and can no longer flow on. As a result of the pressure of following water, the second portion of F1 is diverted into less permeable regions as well, from where it can flow back into the region in which the formulation F2 is located (FIG. 6). The direction of flow is indicated by the arrows 3. As a result, a relatively large gel plug (4) is formed (FIG. 7). The same applies to injection in the order F2, F1 and F2.

The preferred embodiment described may be employed in principle at any formation temperature. However, it is particularly suitable when the temperature of the formation at the point at which the formulations mix is even higher than 80° C., more particularly higher than 100° C., in particular higher than 120° C. The temperature may be situated, for example, in the range from 80° C. to 200° C., 100° C. to 200° C., 120° C. to 200° C., 80° C. to 150° C. or 100° C. to 150° C.

The preferred sequence is F2-F1-F2, in other words, the water-soluble activator, more particularly urea, is injected to begin with. The dissolution of urea in water is endothermic, and so the temperature of the formulation reduces by 10 to 15° C. on dissolution. It is then possible advantageously to inject a cold solution. The temperature of formulation F2 on injection ought preferably to be less than 20° C., more preferably less than 15° C., and very preferably less than 10° C.

In a variant of this embodiment, 3 portions, F1, F2, F1 or F2, F1, F2, are pressed in successively, the viscosity of the formulations increasing from the first to the third formulation injected. This can be done by using viscosity-increasing additives, more particularly thickening polymers. The increasingly higher viscosity has the effect that the formulations do not mix too rapidly. At higher temperatures, customary viscosity-raising polymers lose their effect.

Accordingly, as soon as the formulations warm up under the influence of the formation temperature, their viscosities equalize, and the formulations are able to mix with one another in the manner described.

Process Step (3)

After process step (2), oil production is continued in process step (3) through at least one production borehole. This can be done immediately thereafter, or else optionally after a brief pause, for example a pause of 1 to 3 days.

The oil can preferably be produced by customary methods, by injecting a flooding medium through at least one injection borehole into the deposit, and withdrawing crude oil through at least one production borehole. The flooding medium may especially be carbon dioxide, water and/or steam, preferably steam. The at least one injection borehole may be the injection boreholes already used for injection of formulations F1 and F2, or else other injection boreholes in a suitable arrangement.

However, it will be appreciated that oil production can also be continued by means of other methods known to those skilled in the art. For example, the flooding media used may also be viscous solutions of silicate-containing products or thickening polymers. These may be synthetic polymers, for example polyacrylamide or copolymers comprising acrylamide. In addition, they may be biopolymers, for example particular polysaccharides. In this case, the viscosity of the aqueous flooding medium is adjusted to be higher than that of the last injected formulation F1 or F2.

It will be appreciated that it is possible, after process step (3), to once again perform process steps (2) and (3). This can be done at regular intervals, for example once per year or—in the case of steam flooding—as soon as a steam breakthrough is registered.

Advantages

The novel process for oil extraction has the following advantages compared to known technologies:

- It is possible to reduce the permeability of the highly permeable zones in the carrier with high temperature (90°-320° C.).
- It is possible to operatively block the highly permeable channels in the carrier in the event of steam breakthrough, with brief interruption of steam flooding.

The novel process is inexpensive, does not need any new chemical products for implementation, is based on the use of conventional technical means, and allows an efficient profile modification in carriers with high temperature and very high temperature.

Other Process Variants

Process step (2) need not necessarily be executed after steam flooding. The advantages of the process are also manifested when the temperature at the injection borehole, owing to natural factors, is greater than 90° C., for example 90° C. to 150° C., preferably 100 to 150° C. It is generally possible to produce from such deposits by means of simple water flooding. If the deposit additionally has a comparatively low permeability, the injection rates are correspondingly low for a given pressure. In this case, the pumping of the conventional thermogels is associated with the risk that the injected formulations will gelate directly at the injection boreholes owing to the low flow rate, even at temperatures of 100 to 150° C. This can be avoided by means of the inventive process step (2), in which at least two different formulations F1 and F2 are injected. Possible embodiments for process step (2) have already been described. It is regularly advisable in this embodiment to inject, after the injection of portions F1 and F2, a portion of water (volume approx. 2 to 3 times the total volume of F1 and F2).

In a further process variant, the process according to the invention can also be used in the case of cyclic steam injection and oil production (huff & puff method). The huff & puff method comprises three technological phases (steam flooding, wait, oil production), which are performed cyclically in succession. In a first phase, steam is injected into the deposit. Owing to inhomogeneity of the deposit properties, the steam is distributed inhomogeneously in the carrier and can also lead into the surrounding rock when there is pronounced rock fissuring. In order to prevent this and to increase the efficiency of the steam injection, the first phase is stopped after the pumping of approx. 20 to 50% of the steam volume, and formulations F1 and F2 are pumped sequentially into the hot borehole. There may optionally be further flooding with water. Thereafter, the steam flooding is restarted and the remaining amount of steam (50 to 80%) is injected into the deposit.

The invention is illustrated in detail hereinafter by the working examples which follow:

Laboratory Tests—Core Flooding Test

The process according to the invention was tested by means of a model test. For this purpose, loose deposit material from the oil-bearing stratum of a mineral oil deposit in north-west Germany was compressed in a tube. The permeability of the material was 1 to 12 darcies. The filled tube was provided with devices for injection and withdrawal of liquids at each end, and heated to 200° C. by means of a heater. As the first step, fresh water was introduced into the stratum and withdrawn at the other end, specifically in an amount of 3.9 times the pore volume. Thereafter, a formulation F2 was injected (solution of 40% by weight of urea in water, amount 0.2 times the pore volume), then a portion of water (0.1 times the pore volume), then a formulation F1 (mixture of 30% by weight of an aqueous solution of polyaluminum chloride ($Al_n(OH)_mCl_{3n-m}$, Al content 9.15% by weight, pH<1, ALUSTAR® 1010 L (from Applied Chemicals)) and 70% by weight of water, amount 0.2 times the pore volume), then another portion of water (0.2 times the pore volume) and another portion of formulation F2 (0.2 times the pore volume). After waiting for 18 hours at a constant temperature of 200° C., water flooding was continued.

Figure 2:
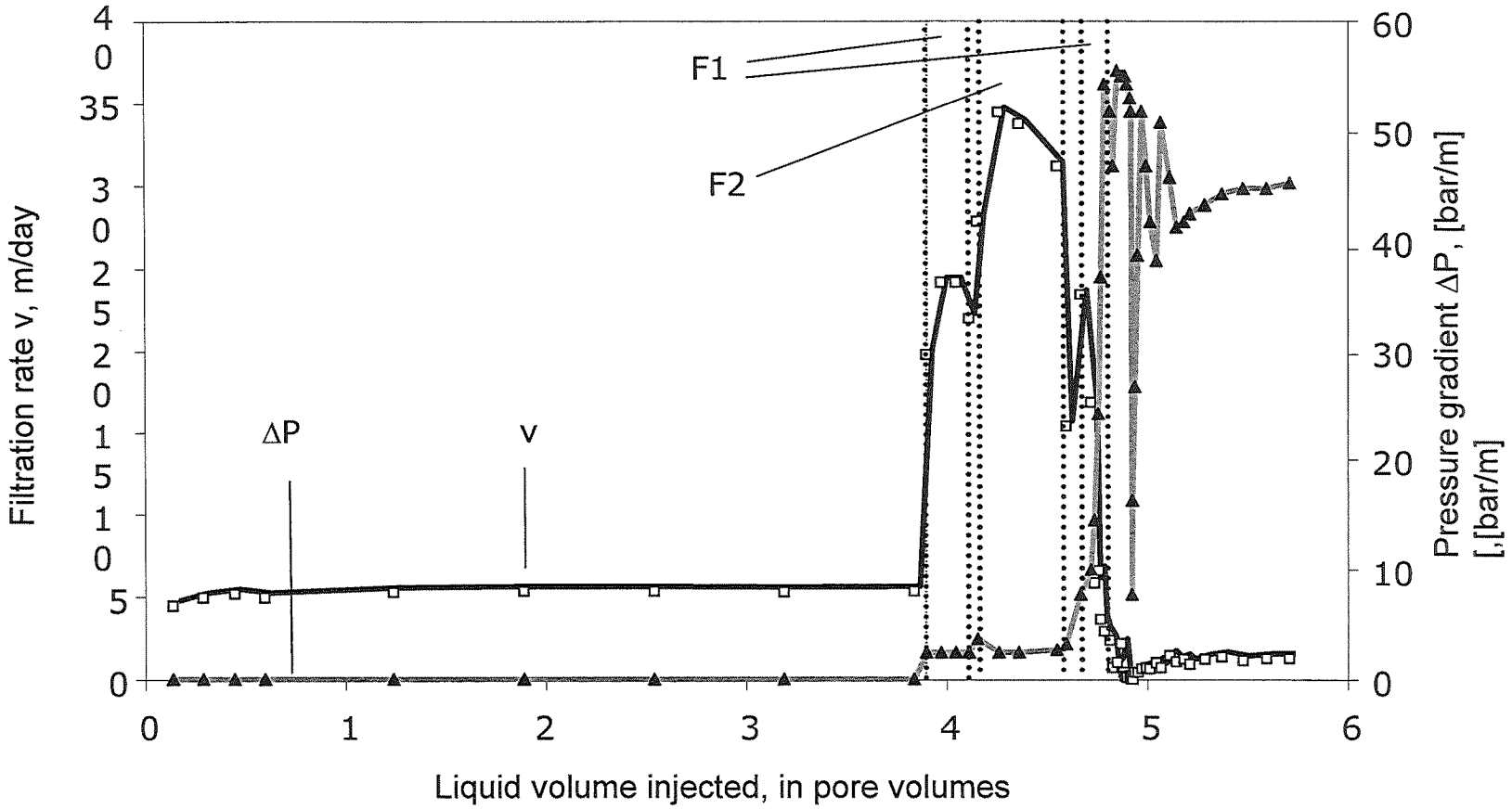

The results of the test are shown in FIG. 2. FIG. 2 shows the volume injected and, as a function thereof, the volume eluted (filtration rate) and the pressure gradient. During water flooding at the start, the pressure gradient is at first low. It rises significantly from 0.073 bar/m to from 43.6 to 53.9 bar/m only after formulations F1 and F2 have each been injected fully. At the same time, water production decreases significantly.

Employment of the Process in an Oil Field

One example of a possible way of executing the process is explained below.

The deposit is a typical deposit containing viscous oil. A section of the deposit has been provided with an injection borehole and several production boreholes, and has already been flooded with steam for several months. The steam temperature is 280-320° C. In some production boreholes which communicate with the injection borehole, rapid watering out of production is being registered. The deposit is fissured as the result of geological faults and has inhomogeneous permeability. Around the injection borehole, an extremely hot zone with a temperature of approx. 240 to 250° C. and a radius of approx. 10 m has formed.

Steam flooding is stopped for a certain time. To cool and flush the borehole, 100 to 200 $m^3$ of water are first pumped at a temperature of 5° C.

In order to perform the profile modification and to block the highly permeable zones in the oil-bearing stratum, a first portion of formulation F2 (40% by weight of urea in water) is prepared above ground in a vessel. It is possible to use fresh water, salt water or formation water. Using customary equipment, 50 $m^3$ of formulation F2 are injected into the deposit through the injection borehole. The first portion of formulation F2 has a low viscosity and flows predominantly through the highly permeable regions of the deposit.

Subsequently, 50 $m^3$ of water are injected into the deposit. By virtue of the injection of the 50 $m^3$ of water, the first portion of formulation F2 is mobilized and forced from the injection borehole into the mineral oil deposit. The deposit temperature, which has fallen briefly to approx. 200° C. as a result of injection of the water into the highly permeable "channels", causes the temperature of the injected formulation F2 also to rise. The viscosity of formulation F2 rises somewhat as a result of formation of gases (incipient decomposition of urea), but no gel is formed.

After the water, 50 $m^3$ of a formulation F1 (30% by weight of aluminum(III) chloride or aluminum(III) nitrate) are injected through the injection borehole. Subsequently, 50 $m^3$ of water are injected and, immediately thereafter, another 50 $m^3$ of the abovementioned formulation F2 are injected. The cycle described is repeated three times without interruption: (50 $m^3$ of water)-(50 $m^3$ of F2)-(50 $m^3$ of water)-(50 $m^3$ of F1). Thus, a total of 200 $m^3$ of F2 and 200 $m^3$ of F1 are pumped in.

As a result of these measures, several banks of the formulation and of the displacing water form in the oil-bearing stratum.

On displacement of the formulation banks, there is retention (adsorption) of urea and metal salt on the rock, and secondly dilution, which leads to a reduction in concentration of the active ingredients in the banks.

As a result of the influence of the deposit temperature, the hydrolysis of the urea to ammonia and carbon dioxide also commences. The gases formed dissolve partly in the water and increase the pH of the water; they additionally form gas emulsions or foam-like microstructures with the water. This reduces the mobility of the first bank formed essentially by the formulation F2. The mobility of the first bank can also be reduced by supplying viscosity-increasing additives into the first portion of formulation F2.

By virtue of the retention (adsorption) of urea in the oil-bearing stratum and by virtue of the reduced mobility of the urea-water solution, the portion of formulation F1 (aqueous solution of the metal salt) injected thereafter catches up with the first bank, i.e. comes into contact with water with elevated pH. The mixing of the first and second banks in the oil-bearing stratum results, within a few minutes, in a gel bank in the highly permeable region of the deposit. The third bank—again composed of formulation F2 (urea solution)—ensures the complete utilization of the metal salt which has remained in rock pores as the result of retention during the displacement. The high concentration selected in the formulations guarantees gel formation even given multiple dilution of the formulations in the solid rock by the formation water and flood water. The compression and displacement of the third bank reduces the permeability of further highly permeable zones between the gel bank and the injection borehole.

By means of the volumes of the injected portions of formulations F1 and F2, and of water, the distance between the injection borehole and the gel bank can be controlled.

The injection pressure also rises with commencement of gelation. After commencement of the injection pressure rise, the water flooding is stopped for one to two days. Thereafter, the water flooding is restarted or steam flooding is continued. After the blockage of highly permeable regions, new flood paths form in wider regions of the oil-bearing stratum under the influence of the flooding medium, and further mineral oil is thus produced from the formation.

The invention claimed is:

1. A process for producing mineral oil from underground mineral oil deposits, the process comprising at least the following process steps:

(1) injection of steam into at least one injection borehole and withdrawal of mineral oil from at least one production borehole, a zone forming between the at least one injection borehole and the production borehole wherein oil is displaced by the steam or water, the temperature at the injection borehole following the injection of the steam is from 120° C. to 320° C., (2) blocking of permeable zones in the mineral oil deposit in the zone by injecting aqueous formulations through the same at least one injection borehole into which the steam was injected, said formulations comprising water and chemical components which, after injection into the deposit, can form viscous water-insoluble gels at a deposit temperature of from 100° C. to 200° C. and (3) collecting mineral oil from the at least one production borehole, wherein the aqueous formulations comprise:

an acidic formulation F1 that includes water and at least one of a water-soluble aluminum(III) salt and a partially hydrolyzed aluminum(III) salt, and a formulation F2 that includes water and at least one water-soluble activator, the activator providing an increase in the pH at a temperature of greater than 50° C., the activator selected from urea or a substituted water-soluble urea, wherein the formulation F1 and the formulation F2 are injected separately into the deposit in succession, in the sequence F1-F2-F1 or F2-F1-F2, the viscosity $\eta$ of the three sequenced formulations is subject to the relation $\eta(F1)<\eta(F2)<\eta(F1)$ or $\eta(F2)<\eta(F1)<\eta(F2)$, wherein the viscosity is adjusted with viscosity-increasing additives, the two formulations mixing with one another in the mineral oil formation, and at the deposit temperature form the viscous water-insoluble gels, the gels forming block cavities in the mineral oil formation that block the permeable zones to flow paths of water and/ or steam.

2. The process according to claim 1, wherein the aluminum(III) salt is aluminum chloride or aluminum nitrate.

3. The process according to claim 1, wherein the water-soluble activator in formulation F2 is urea.

4. The process according to claim 1, wherein the concentration of the aluminum (III) compounds in formulation F1 is 5 to 25% anhydrous aluminum(III) compounds by weight.

5. The process according to claim 1, wherein the concentration of water-soluble activators in formulation F2 is 10 to 45% by weight.

6. The process according to claim 1, wherein the sequence of injection is F2-F1-F2.

7. The process according to claim 6, wherein the temperature of the first injected formulation F2 is less than 20° C.

8. The process according to claim 1, wherein the viscosity-increasing additives are selected from the group of polyacrylamides, copolymers comprising acrylamide, xanthans, or a mixture thereof.

9. The process according to claim 1, wherein a portion of water is injected between the injection of formulations F1 and F2.

10. The process according to claim 1, wherein a portion of water is injected between process steps (1) and (2).

11. The process according to claim 1, wherein the oil production in process step (3) is continued by injecting steam.

12. The process according to claim 1, wherein the oil production in process step (3) is continued by injecting an aqueous solution of a thickening polymer.

13. The process according to claim 12, wherein the viscosity $\eta$ of the injected polymer solution is higher than the viscosity of the last-injected formulation F1 or F2.

14. The process according to claim 1, wherein the process step (2) further includes measuring the temperature in the region of the injection borehole to determine the temperature field of the deposit in a region affected by the steam flooding.

15. The process according to claim 14, wherein process step (2) is started upon watering out of production or a steam breakthrough is registered.

16. The process according to claim 1, wherein the temperature in the region of the injection borehole is lowered prior to process step (2).

17. A process for producing mineral oil from underground mineral oil, the process comprising;

(1) injection of steam into at least one injection borehole and withdrawal of mineral oil from at least one production borehole, a zone forming between the at least one injection borehole and the production borehole wherein oil is displaced by the steam or water, the temperature at the injection borehole following the injection of the steam is from 120° C. to 320° C., (2) blocking of permeable zones in the mineral oil deposit in the zone by injecting aqueous formulations through the same at least one injection borehole into which the steam was injected, said formulations comprising water and chemical components which, after injection into the deposit, can form viscous water-insoluble gels at a deposit temperature from 100° C. to 200° C., and (3) collecting mineral oil from the at least one production borehole, wherein the aqueous formulations comprise an acidic formulation F1 that includes water and at least one of a water-soluble aluminum(III) salt and a partially hydrolyzed aluminum(III) salt, and a formulation F2 that includes water and 10 to 45% by weight of at least one water-soluble activator, the activator providing an increase in the pH at a temperature of greater than 50° C., the activator selected from urea or a substituted water-soluble urea, wherein the formulation F1and the formulation F2 are injected separately into the deposit in the sequence, F1-F2-F1 or F2-F1-F2, the viscosity $\eta$ of the three sequenced formulations is subject to the relation $$\eta(F1)<\eta(F2)<\eta(F1), \text{ or } \eta(F2)<\eta(F1)<\eta(F2),$$

wherein the viscosity is adjusted with viscosity-increasing additives, the two formulations mixing with one another in the mineral oil formation, and at the deposit temperature form the viscous water-insoluble gels, the gels forming block cavities in the mineral oil formation that block the permeable zones to flow paths of water and/or steam.

18. The process according to claim 17, wherein the collecting of the mineral oil in process step (3) includes injecting steam, or an aqueous solution of a thickening polymer, into the at least one injection borehole.

19. The process according to claim 1, wherein the blocking of permeable zones in the mineral oil deposit in the zone includes forming the viscous water-insoluble gels at a deposit temperature of from 100° C. to 150° C.

20. The process according to claim 8, wherein the blocking of permeable zones in the mineral oil deposit in the zone includes forming the viscous water-insoluble gels at a deposit temperature of from 100° C. to 150° C.

* * * * *